United States Patent [19]

Woodward

[11] 4,240,080

[45] Dec. 16, 1980

[54] SHORT BACKFIRE ANTENNA WITH SUM AND ERROR PATTERNS

[75] Inventor: Oakley M. Woodward, Princeton, N.J.

[73] Assignee: The United States of America as represented by the Secretary of the Army, Washington, D.C.

[21] Appl. No.: 95,731

[22] Filed: Nov. 19, 1979

[51] Int. Cl.[3] ..... H01Q 19/185; H01Q 25/02

[52] U.S. Cl. ..... 343/817; 343/836; 343/854

[58] Field of Search ..... 343/815, 816, 817, 834, 343/835, 836, 837, 854

[56] References Cited

U.S. PATENT DOCUMENTS 3,742,513 6/1973 Ehrenspeck ..... 343/837

*Primary Examiner*—Eli Lieberman

*Attorney, Agent, or Firm*—Nathan Edelberg; Jeremiah G. Murray; Edward Goldberg

[57] ABSTRACT

A simplified short backfire directional antenna provides both sum and error radiation patterns in the H-plane. Three parallel dipoles are mounted above a pan-type reflector, with a small metal reflector disc over the dipoles. The center dipole is excited to produce a sum pattern and the two end dipoles are excited out of phase to provide an error pattern with a broadside null in the H-plane. Alternatively, a hybrid circuit may be used with a pair of parallel dipoles to generate the desired patterns. Improved gain and resolution are achieved with a small antenna array.

10 Claims, 7 Drawing Figures

FIG. 1
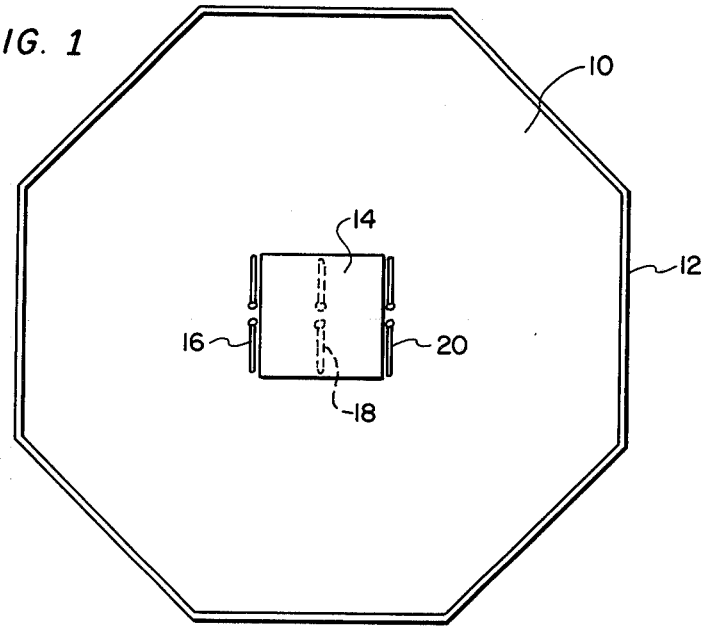
FIG. 2
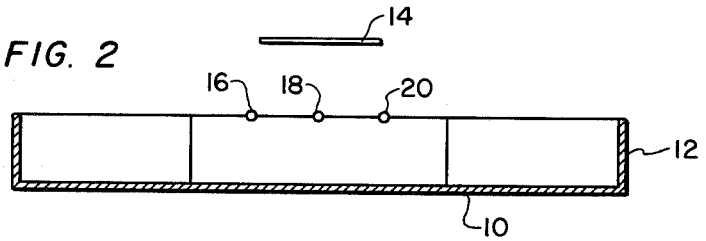
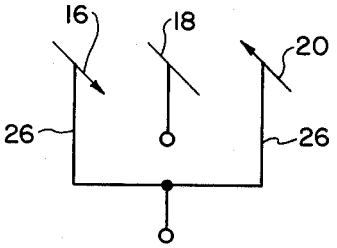
FIG. 4
THREE-DIPOLE EXCITER
FIG. 5
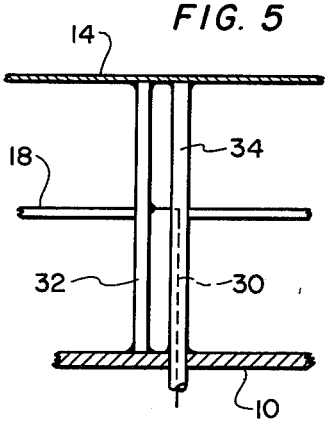
FIG. 6
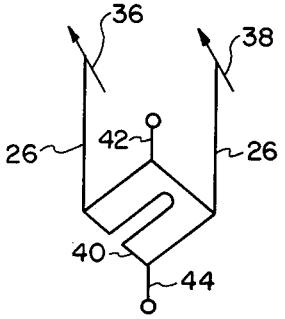
TWO-DIPOLE EXCITER

SHORT BACKFIRE ANTENNA WITH SUM AND ERROR PATTERNS

The invention described herein may be manufactured, used and licensed by or for the Government for governmental purposes without the payment of any royalty thereon.

BACKGROUND OF THE INVENTION

1. Field of the Invention

The present invention relates to directional antennas and particularly to a short backfire antenna having both sum and error radiation patterns in the H-plane.

2. Description of the Prior Art

The presently known short backfire antenna utilizes a shallow rimmed pan-type reflector and a smaller planar reflector plate or disc spaced apart about one-half wavelength along a common axis to form a resonant cavity therebetween. A single dipole feed element is positioned along the axis between the planar reflectors to provide a highly directive endfire type pattern in the H-plane. Such an antenna is described more fully in U.S. Pat. No. 3,508,278 issued Apr. 21, 1970. This antenna is capable of providing a single lobe unidirectional or sum pattern in the E- and H-planes. It does not, however, provide an error, or split lobe pattern, having a broadside null in the H-plane, which is desirable in some particular target direction finding and interrogation applications. In order to obtain such a combination of sum and error patterns in the past, it was necessary to use more complex broadside arrays of nine or more dipoles.

SUMMARY OF THE INVENTION

It is therefore the primary object of the present invention to provide a simplified short backfire antenna which is capable of directional radiation having both sum and error patterns in the H-plane.

It is a further object of the invention to provide a short backfire antenna having sum and error patterns with improved resolution and gain.

This is accomplished with a modified short backfire type antenna utilizing a rimmed metal pan reflector and a smaller disc reflector spaced along a common axis to form a resonant cavity. Three parallel dipoles are positioned between the reflectors, with the center dipole excitation providing a sum pattern in both E- and H-planes, while the outer pair are fed out-of-phase to provide an error pattern having a broadside null in the H-plane. A hybrid circuit may be used in place of the center dipole in conjunction with two in-phase dipoles to achieve the same patterns. The sum pattern amplitude is made to exceed the error pattern only in the angular vicinity of the broadside null to achieve improved resolution and gain equivalent to a larger antenna. For simplicity in construction, an octagonal reflector pan and square shaped disc reflector are utilized. Other objects and advantages will become apparent from the following description in conjunction with the accompanying drawings.

BRIEF DESCRIPTION OF THE DRAWINGS

FIG. 1 is a plan view of a reflector pan, disc reflector and three dipole elements of the antenna of the present invention;

FIG. 2 is a cross-sectional end view of the antenna of FIG. 1 without the supports for the dipoles and disc reflector;

FIG. 4 is a schematic representation showing the phase relationship for connection of signals to the antenna dipoles;

FIG. 5 is a partial end view cross section showing the support and coupling structure for a dipole and reflector; and FIG. 6 is a schematic representation of an alternate embodiment utilizing two dipoles.

DESCRIPTION OF THE PREFERRED EMBODIMENTS

As shown in FIGS. 1 and 2, a pan-type reflector 10, having a width of approximately two wavelengths, includes a vertical rim 12 of about one-quarter wavelength extending about the perimeter of the pan. A smaller metal reflector disc 14 of about 0.4 wavelength in width is positioned centrally and parallel to the larger pan reflector and spaced about one-half wavelength above the pan along a common vertical axis to form a resonant cavity therebetween. The reflector pan is shown having an octagonal shape and the reflector disc is square, which configurations permit simplified fabrication. The theoretically preferred shape, however, would be circular for both.

Figure 3A:
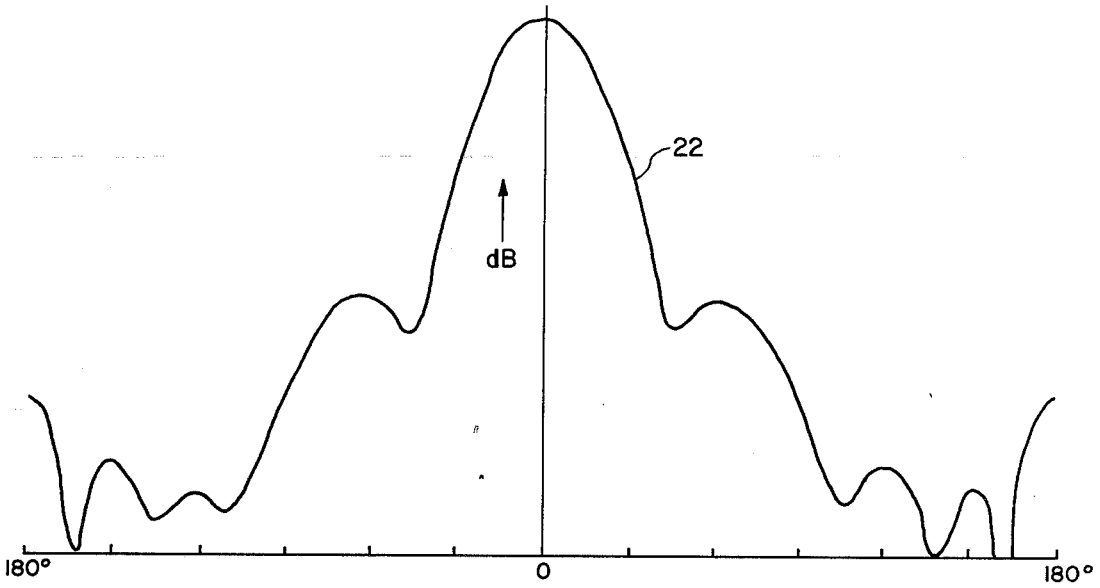
FIGS. 3*a* and 3*b* show curves of the E- and H-plane radiation patterns of the antenna.
Figure 3B:
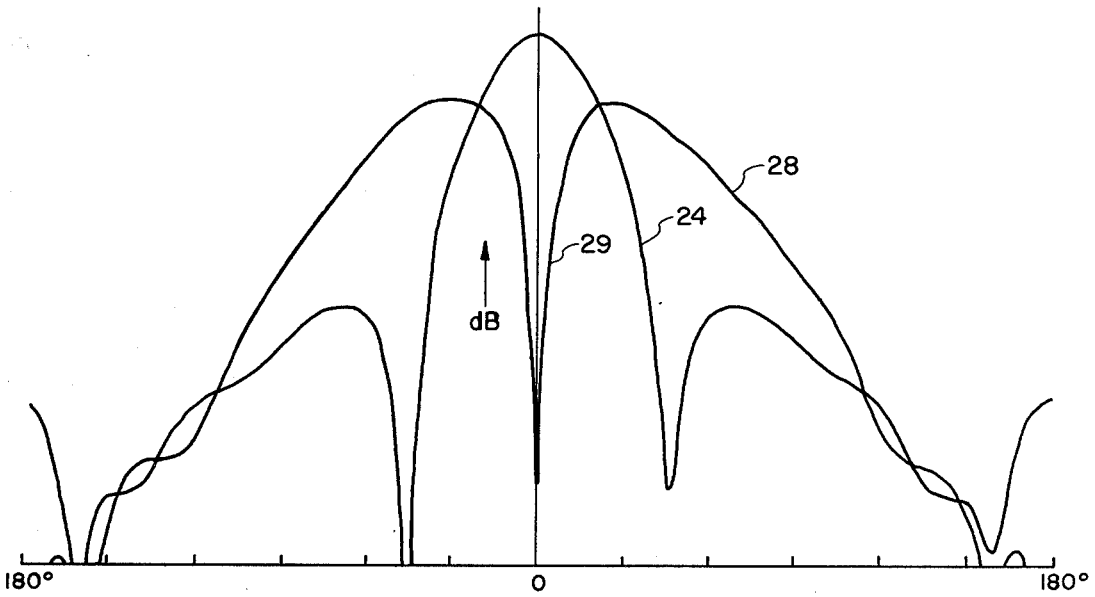

Positioned at one-quarter wavelength above the pan between the two reflectors, are three small parallel dipole feed elements 16, 18, 20. Excitation of the central dipole 18 produces like sum patterns 22, 24 in the E- and H-planes, as shown in FIGS. 3*a* and 3*b*, with typical operating frequencies of 1030 and 1090 MHz. A conical beam having a gain of about 15 db above isotropic is obtained with very low side and back lobes. The additional dipoles 16, 20 are disposed so that one is physically rotated 180 degrees out-of-phase with respect to the other. Thus, when the two outer dipoles are fed from a "tee" junction with equal length lines 26, as shown in FIG. 4, an error pattern 28 (FIG. 3*b*) is obtained having a broad-side null 29 in the H-plane. The lengths of lines 26 are selected to de-tune the outer dipoles to avoid pattern interaction in the sum mode of operation. The affect of reradiation on the center dipole 18 is thus reduced. The sum pattern amplitude preferably exceeds the error pattern only in the limited angular region of the error pattern null directed broadside to the reflector pan at least over the major portion of the forward hemisphere. This permits a relatively small aperture to have a sharp resolution equivalent to that of a larger antenna. The combination of sum and error patterns provides greater azimuth information for improved target location. Other desired patterns can be obtained by lobe switching arrangemets. Dimensions of the reflector disc and outer dipole spacing are selected to provide optimum pattern shaping and gain.

FIG. 5 shows a typical balun support structure for the center dipole 18 and reflector disc 14, while the outer dipoles would be supported in a like manner only by the lower balun section. An input coaxial line inner conductor 30 is connected to one side of dipole 18 secured on grounded center support 32, while an outer conductor 34 connects to the other side of the dipole and the metal disc 14.

As shown in FIG. 6, an alternative feed system may employ two parallel in-phase dipoles 36, 38 and an intermediate hybrid ring "rat-race" 40 with equal feed lines to generate both sum and error patterns in the H-plane. In this case, there are no pattern interaction problems between sum and error feeds, but a hybrid circuit is required to achieve the desired phase relationships. The sum pattern is obtained by in-phase excitation of the two dipoles from one end 42 of the hybrid, while the error pattern is obtained by out-of-phase excitation from the other end 44 of the hybrid.

While only a limited number of embodiments have been illustrated and described, it is apparent that many variations may be made in the particular design and configuration without departing from the scope of the invention as set forth in the appended claims.

What is claimed is:

1. A radio-frequency directional antenna comprising:

a first reflector plate having an axially extending peripheral rim;

a second reflector disc disposed centrally and parallel to said first plate and spaced from said plate and rim at a given distance along a common longitudinal axis, the width of said second reflector being a relatively small fraction of that of said first reflector;

a plurality of parallel dipole feed elements positioned symmetrically about said axis at a given distance between said first and second reflectors; and means for applying electromagnetic energy to said dipole feed elements to provide sum and error radiation distribution patterns in the H-plane.

2. The antenna of claim 1 wherein said plurality of dipole elements includes a center dipole and a pair of outer dipoles, each of said pair being 180 degrees out of phase with respect to the other, said means for applying electromagnetic energy to said center dipole producing a sum pattern and said means for applying said energy to said outer dipoles producing an error pattern having a broadside null in the H-plane.

3. The antenna of claim 1 including support means for said plurality of dipoles, said support means extending from said first reflector plate and being in the form of baluns.

4. The antenna of claim 1 wherein said first reflector plate is approximately two wavelengths in width, said second reflector is about 0.4 wavelength in width, said rim is about 0.25 wavelength in height, said dipoles are spaced about 0.25 wavelength from said first reflector plate, and said second reflector disc is spaced about 0.05 wavelength from said first reflector to form a resonant cavity therebetween.

5. The antenna of claim 2 wherein said means for applying energy to said outer dipoles includes feed lines of equal length.

6. The antenna of claim 2 including support means for said second reflector and said plurality of dipoles, said support means including a balun supporting said center dipole and second reflector.

7. The antenna of claim 2 wherein the sum pattern amplitude exceeds the error pattern amplitude in the angular region of the error pattern broadside null.

8. The antenna of claim 5 wherein said feed line lengths are selected to de-tune the outer dipoles to minimize pattern interaction in the sum mode of operation.

9. The antenna of claim 1 wherein said plurality of dipole elements includes a pair of dipoles, said means for applying electromagnetic energy including means for applying said energy in-phase to said pair of dipoles to produce said sum pattern and out-of-phase to produce said error pattern.

10. The antenna of claim 9 wherein said means for applying said energy out-of-phase includes a hybrid ring connected between said pair of dipoles and having connections at opposite ends of said hybrid ring for applying said energy in-phase and out-of-phase.

* * * * *